US012054310B2

(12) United States Patent
Rowe

(10) Patent No.: US 12,054,310 B2
(45) Date of Patent: Aug. 6, 2024

(54) ELECTRICALLY ACTUATABLE CONTAINERS AND METHODS FOR USE

(71) Applicant: Toyota Motor Engineering & Manufacturing North America, Inc., Plano, TX (US)

(72) Inventor: Michael P. Rowe, Pinckney, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 285 days.

(21) Appl. No.: 17/687,966

(22) Filed: Mar. 7, 2022

(65) Prior Publication Data

US 2023/0114078 A1 Apr. 13, 2023

Related U.S. Application Data

(60) Provisional application No. 63/253,273, filed on Oct. 7, 2021.

(51) Int. Cl.
*B65D 21/08* (2006.01)
*B65D 65/40* (2006.01)

(52) U.S. Cl.
CPC ..... *B65D 21/086* (2013.01); *B65D 65/40* (2013.01)

(58) Field of Classification Search
CPC ..... B65D 21/086; B65D 65/40; B65D 65/38; B65D 25/14
USPC ..... 220/62.11, 62.16, 4.01, 4.21, 4.26, 4.6
See application file for complete search history.

(56) References Cited

U.S. PATENT DOCUMENTS

| | | | | |
|---|---|---|---|---|
| 5,366,124 | A | 11/1994 | Dearborn, IV | |
| 6,637,617 | B2 | 10/2003 | Eisenbraun et al. | |
| 8,196,648 | B2 | 6/2012 | Matsukawa | |
| 2002/0145022 | A1 | 10/2002 | Nguyen et al. | |
| 2004/0031895 | A1 | 2/2004 | Langhoff | |
| 2012/0168433 | A1* | 7/2012 | Cheng | B65D 7/14 220/4.01 |
| 2016/0197516 | A1* | 7/2016 | Pike | H02J 7/35 320/101 |
| 2020/0254937 | A1 | 8/2020 | Ginzburg | |

FOREIGN PATENT DOCUMENTS

JP 2017011837 A * 1/2017

* cited by examiner

*Primary Examiner* — Rafael A Ortiz
(74) *Attorney, Agent, or Firm* — Dinsmore & Shohl LLP

(57) ABSTRACT

An actuatable container includes a first electrode panel and a second electrode panel, wherein the first electrode panel and the second electrode panel each comprises an electrode, an electrode insulation coating surrounding the electrode, an electrode lead, and a plurality of fold regions, the first electrode panel and the second electrode panel are each foldable along the plurality of fold regions to permit the first electrode panel and the second electrode panel to move between a first form and a second form, and the first electrode panel is electrically engageable with the second electrode panel, upon application of a voltage to the first electrode panel and the second electrode panel, to retain the first electrode panel and the second electrode panel in the second form.

15 Claims, 9 Drawing Sheets

ELECTRICALLY ACTUATABLE CONTAINERS AND METHODS FOR USE

CROSS-REFERENCE TO RELATED APPLICATION

This application claims the benefit of U.S. Provisional Patent Application No. 63/253,273 entitled "GO-FLAT ITEM HOLDER AND ORGANIZER," filed Oct. 7, 2021, the entirety of which is hereby incorporated by reference.

TECHNICAL FIELD

The present disclosure relates to reconfigurable spaces, and more particularly to electrically actuatable containers.

BACKGROUND

To make efficient use of space, a space may be compartmentalized. Compartments such as shelves may be used to make efficient use of vertical space. Similarly, compartments such as dividers may be used to make efficient use of horizontal space. To make further efficient use of space, compartments may also come in a variety of sizes to hold items of various sizes. In some cases, compartments may even be modular to adapt to a variety of situations. However, relying on static and/or mechanical designs for modular compartments still limit the use of space. Although static designs provide rigidity, they lack modularity. Moreover, although mechanical designs can provide modularity, they still occupy a non-trivial amount of space when not in use.

Accordingly, there is a need for compartments that can provide modularity and are inconspicuous when not in use.

SUMMARY

In accordance with one embodiment of the present disclosure, an actuatable container includes a first electrode panel and a second electrode panel, wherein the first electrode panel and the second electrode panel each comprises an electrode, an electrode insulation coating surrounding the electrode, an electrode lead, and a plurality of fold regions, the first electrode panel and the second electrode panel are each foldable along the plurality of fold regions to permit the first electrode panel and the second electrode panel to move between a first form and a second form, and the first electrode panel is electrically engageable with the second electrode panel, upon application of a voltage to at least one of the first electrode panel or the second electrode panel, to retain the first electrode panel and the second electrode panel in the second form.

In accordance with another embodiment of the present disclosure, a method includes folding a first electrode panel and a second electrode panel from a first form to a second form, the first electrode panel and the second electrode panel being mirror images of one another and applying a voltage to at least one of the first electrode panel or the second electrode panel to retain the first electrode panel and the second electrode panel in the second form.

In accordance with yet another embodiment of the present disclosure, an actuatable container includes a first electrode panel, a second electrode panel overlapping the first electrode panel, and a power supply for delivering a voltage to at least one of the first electrode panel or the second electrode panel. The first electrode panel includes one or more fold regions and a plurality of sections defined by the one or more fold regions. The second electrode panel includes one or more fold regions and a plurality of sections defined by the one or more fold regions. The actuatable container is positionable between a first form in which the plurality of sections of the first electrode panel and the plurality of sections of the second electrode panel are parallel to one another, and a second form in which one or more sections of the plurality of sections of the first electrode panel and one or more sections of the second electrode panel fold at corresponding fold regions such that the one or more sections of the first electrode panel and the one or more sections of the second electrode panel are perpendicular to other sections of the first electrode panel and other sections of the second electrode panel.

Although the concepts of the present disclosure are described herein with primary reference to vehicles, it is contemplated that the concepts will enjoy applicability to any object having open space. For example, and not as limitation, it is contemplated that the concepts of the present disclosure may enjoy applicability to home furniture.

BRIEF DESCRIPTION OF THE DRAWINGS

The following detailed description of specific embodiments of the present disclosure can be best understood when read in conjunction with the following drawings, where like structure is indicated with like reference numerals and in which.

DETAILED DESCRIPTION

The embodiments disclosed herein include actuatable containers and methods for using actuatable containers. In embodiments disclosed herein, an actuatable container may be a modular container that is held together by electrically engageable components, such as electrodes, and not by purely mechanical components, such as hook and loop fasteners. Although modular containers that are held together by mechanical components are beneficial for their flexibility in making efficient use of a space, they still occupy a non-trivial amount of space when they are not in use. Therefore, the modular panels still require space to be stored when not in use and reduce the amount of available storage space when not in use.

To resolve this issue, embodiments of the actuatable container described herein include a plurality of electrode panels overlaid with one another that can lay flat and/or flush with a surface when not in use. The electrode panels may be folded to form a container when ready for use and retain its form by receiving a voltage through the electrode panels. Embodiments may also contain support structures to provide added rigidity to the electrically actuatable container. Embodiments may also be a wall, divider, barrier, or any other structure for transforming an area into a container by actuation of the electrode panels.

Figure 1A:
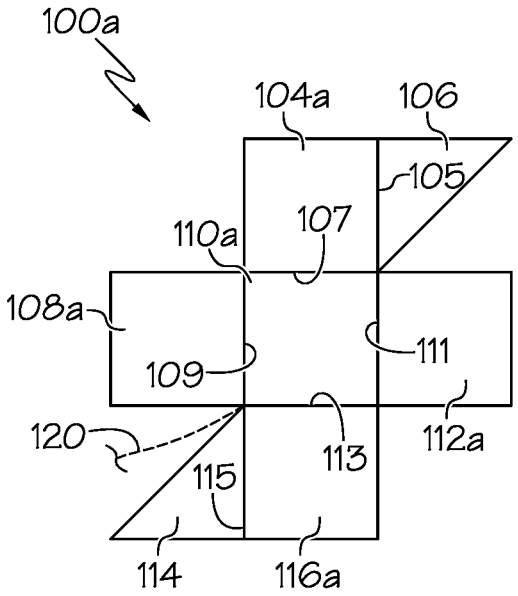
FIG. 1A depicts a plan view of a first electrode panel, according to one or more embodiments shown and described herein.

Referring now to FIG. 1A, an actuatable container 100 is depicted. The actuatable container 100 may include a plurality of electrode panels. A first electrode panel 100*a* of the plurality of electrode panels includes an electrode and an electrode insulation coating surrounding the electrode. The various components of the first electrode panel 100*a* will be discussed in more detail herein with reference to FIG. 4.

The first electrode panel 100*a* may also have a plurality of sections 104*a*, 106, 108*a*, 110*a*, 112*a*, 114, 116*a*. The plurality of sections 104*a*, 106, 108*a*, 110*a*, 112*a*, 114, 116*a* are separated from one another by a plurality of fold regions 105, 107, 109, 111, 113, 115, 117. The fold regions 105, 107, 109, 111, 113, 115, 117 may be any part of the first electrode panel 100*a* which permit the sections 104*a*, 106, 108*a*, 110*a*, 112*a*, 114, 116*a* to move relative to one another. For example, a fold region 105, 107, 109, 111, 113, 115, 117 may be a crease, bend, or the like. The fold regions 105, 107, 109, 111, 113, 115, 117 of the first electrode panel 100*a* may be placed such that the first electrode panel 100*a* is foldable along any of the plurality of fold regions 105, 107, 109, 111, 113, 115, 117. Being foldable allows the first electrode panel 100*a* or the sections 104*a*, 106, 108*a*, 110*a*, 112*a*, 114, 116*a* thereof to move between a first form and a second form. In the first form, the first electrode panel 100*a* may be flat, and thus the fold regions 105, 107, 109, 111, 113, 115, 117 may not be apparent. More particularly, in the first form, the sections 104*a*, 106, 108*a*, 110*a*, 112*a*, 114, 116*a* are parallel to one another. In the second form, which may be a three-dimensional shape, the fold regions 105, 107, 109, 111, 113, 115, 117 of the first electrode panel 100*a* may make up one or more edges, and the sections 104*a*, 106, 108*a*, 110*a*, 112*a*, 114, 116*a* define one or more faces of the second form.

The first electrode panel 100*a* may start in the first form, such as a flat planar shape. When the first electrode panel 100*a* is folded, it may take the second form, such as a polyhedron or cylinder shape. In some embodiments, the second form may include one or more openings defined by adjacent sections 104*a*, 106, 108*a*, 110*a*, 112*a*, 114, 116*a* for holding one or more objects, such as a cup. The first electrode panel 100*a* may also take a third or a plurality of additional forms either intermediate of the first form and the second form, or subsequent to the second form. For example, the first electrode panel 100*a* may be folded such that it engages with another one or more electrode panels to create more complex structures, such as structures resembling shelving or other organizational structures. Folding may occur manually or automatically such as by generating a voltage throughout the first electrode panel 100*a*. To fold the first electrode panel 100*a* manually, a user may fold the first electrode panel 100*a* at one or more fold regions 105, 107, 109, 111, 113, 115, 117 from the first form to the second form and actuate the first electrode panel 100*a* by applying a voltage to the first electrode panel 100*a* to retain the second form. To fold the first electrode panel 100*a* automatically, the user may actuate the first electrode panel 100*a* by applying a voltage applied to the first electrode panel 100*a* and, in response to actuation, may cause the first electrode panel 100*a* to fold at one or more fold regions 105, 107, 109, 111, 113, 115, 117 from the first form to the second form and, in some embodiments, retain the second form.

Figure 1B:
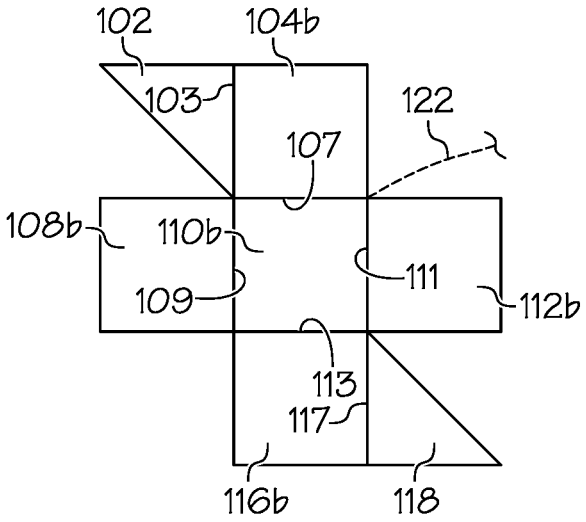
FIG. 1B depicts a plan view of a second electrode panel, according to one or more embodiments shown and described herein.

The first electrode panel 100*a* may be electrically engageable with one or more other electrode panels, such as a second electrode panel 100*b* illustrated in FIG. 1B. The electrode panels 100*a*, 100*b* may be electrically engaged with one another and retain the second form upon application of the voltage. Once electrically engaged, the electrode panels 100*a*, 100*b* may be attracted to each other and retain the second form. A voltage may also be applied when the first electrode panel 100*a* is in the first form to keep the first electrode panel 100*a* flat with a surface. In some embodiments, sections 106, 114 of the first electrode panel 100*a* may define engagement sections 106, 114 and extend from adjacent sections 104*a*, 116*a*, respectively. For example, the first electrode panel 100*a* may have a flap, a wing, a tongue, and/or the like that is folded over the second electrode panel 100*b* when in the second form to retain or strengthen retention of the second form when a voltage is applied. For added security, the second electrode panel 100*b* may also have a flap, a wing, a tongue, and/or the like that is folded over the first electrode panel 100*a* when in the second form to retain or strengthen retention of the second form when a voltage is applied. In some embodiments, the engagement sections 106, 114 may be defined by fold regions 105, 115.

The materials used to create the first electrode panel 100*a* result in the first electrode panel 100*a* being thin enough to substantially blend in with the surface upon which it rests. For example, the first electrode panel 100*a* may only be less than 5 millimeters and thus may be substantially flush with the surface upon which it rests. As another example, the surface may include an indentation having a depth equivalent to the thickness of the first electrode panel 100*a* such that the first electrode panel 100*a* is flush with the surface upon which it rests.

Referring now to FIG. 1B, the second electrode panel 100*b* is illustrated. It should be appreciated that the second electrode panel 100*b*, in embodiments, complements the first electrode panel 100*a* described above. As such, the second electrode panel 100*b* may be identical in structure or a mirror image to the first electrode panel 100*a*. Accordingly, the second electrode panel 100*b* may include an electrode, an electrode insulation coating surrounding the electrode, and a second electrode lead 122. Each component of the second electrode panel 100*b* is similar to the corresponding component of the first electrode panel 100*a*. Accordingly, the second electrode panel 100*b* may have sections 102, 104*b*, 108*b*, 10*b*, 112*b*, 116*b*, 118 separated by fold regions 103, 107, 109, 111, 113, 117.

Figure 1C:
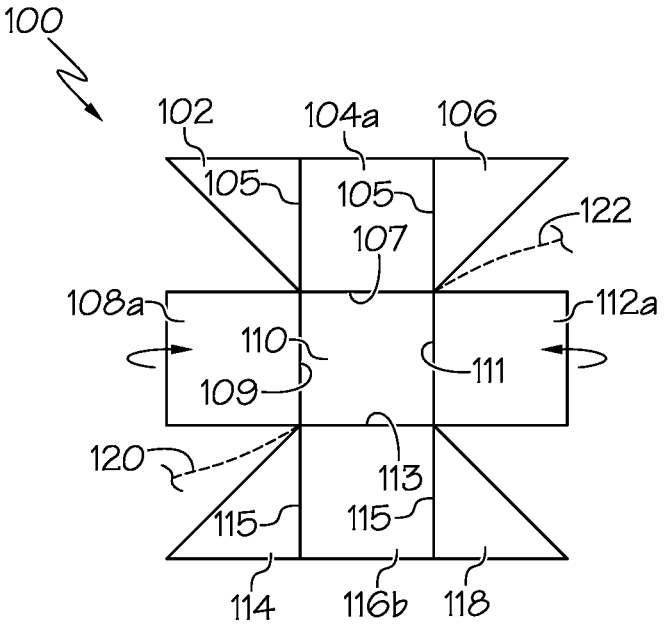
FIG. 1C depicts a plan view of the first electrode panel of FIG. 1A and the second electrode panel of FIG. 1B forming an actuatable container, according to one or more embodiments shown and described herein.
Figure 1D:
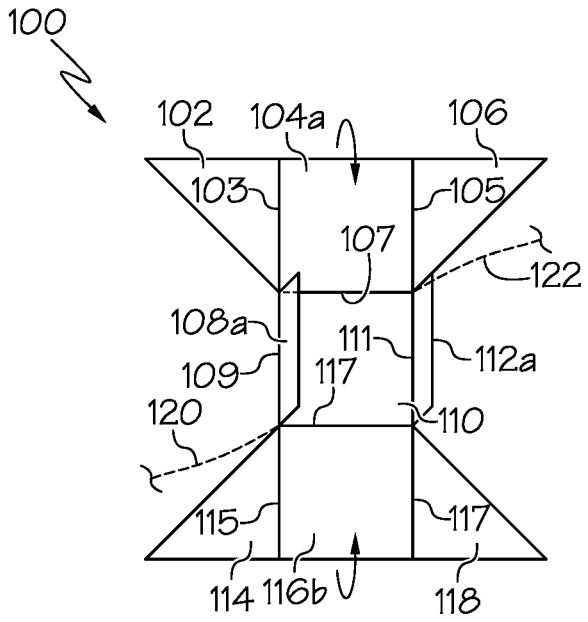
FIG. 1D depicts a perspective view of the actuatable container of FIG. 1C formed into a first position, according to one or more embodiments shown and described herein.
Figure 1E:
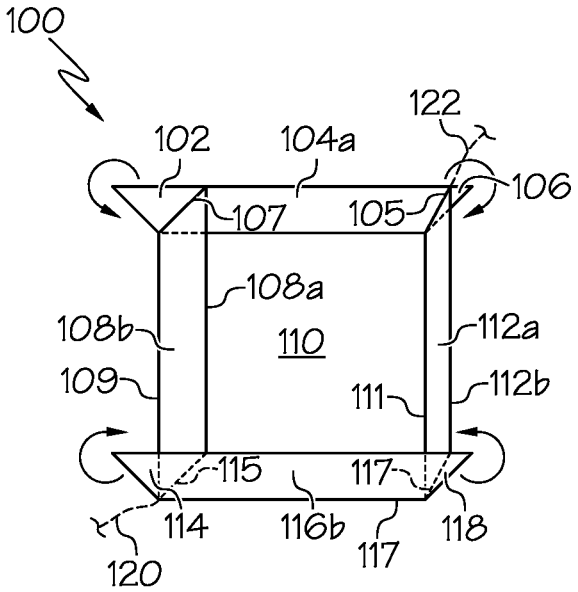
FIG. 1E depicts a perspective view of the actuatable container of FIG. 1C formed into a second position, according to one or more embodiments shown and described herein.

FIG. 1C depicts an actuatable container 100 formed by placing the first electrode panel 100*a* and the second electrode panel 100*b* on top of one another. The sections 104*a*, 108*a*, 112*a*, 116*a* of the first electrode panel 100*a* and sections 104*b*, 108*b*, 112*b*, 116*b* of the second electrode panel 100*b* may be folded as illustrated in FIGS. 1D-1E to move from the first form to the second form, thereby creating the actuatable container 100 having a cube shape with an open top. Once the sections 104*a*, 108*a*, 112*a*, 116*a* of the first electrode panel 100*a* and sections 104*b*, 108*b*, 112*b*, 116*b* of the second electrode panel 100*b* are folded, the engagement sections 106, 114 of the first electrode panel 100*a* and the engagement sections 102, 118 of the second electrode panel 100*b* are folded. After folding, the voltage may be applied or maintained, or a second voltage applied to the first electrode panel 100*a* and the second electrode panel 100*b* to retain the first electrode panel 100*a* and the second electrode panel 100*b* in the second form. In some embodiments, applying a voltage may automatically fold the electrode panels 100*a*, 100*b* from the first form to the second form and keep the electrode panels 100*a*, 100*b* in the second form.

As discussed herein, one or more sections of the plurality of sections may be considered engagement sections, such as sections 102, 106, 114, 118. The engagement sections 102, 106, 114, 118 are not necessary for the formation of the second form. However, the engagement sections 102, 106, 114, 118 may facilitate or improve engagement between the first electrode panel 100*a* with the second electrode panel 100*b* and vice versa. For example, when in the second form, the electrode panels 100*a*, 100*b* may selectively electrically engage the engagement sections 102, 106, 114, 118 to retain the second form, although additional sections may be electrically engaged.

The first electrode lead 120 may be connected to a power supply 506 (FIG. 5) that gives the first electrode panel 100*a* a positive polarity. The second electrode lead 122 may be connected to a power supply 506 (FIG. 5) that gives the second electrode panel 100*b* a negative polarity. The difference in polarity between the first electrode panel 100*a* and the second electrode panel 100*b* allows the electrode panels 100*a*, 100*b* to stick or electrically adhere together. For example, the first electrode panel 100*a* may be placed atop the second electrode panel 100*b*. When a voltage is applied to the first electrode lead 120 and the second electrode lead 122, the first electrode panel 100*a* may stick to the second electrode panel 100*b* due to the difference in their polarity. The applied voltage may also help the first electrode panel 100*a* and the second electrode panel 100*b* stay flat on a surface when not in use.

Referring to FIG. 1D, the actuatable container 100 is depicted in a partially formed state having a first set of walls 108, 112 defined by sections 108*a*, 108*b*, 112*a*, 112*b*. As shown in FIG. 1E, sections 104*a*, 104*b*, 116*a*, 116*b* may be folded to form a second set of walls 104, 116 of the actuatable container 100, thereby enclosing the space around a section 110, corresponding to overlapping sections 110*a*, 110*b*, and forming an opening above the section 110. The first set of walls 108, 112 and the second set of walls 104, 116 may be perpendicular to the base section 110.

Referring now to FIG. 1E, the engagement sections 106, 114 are folded over sections 112*b*, 108*b*, respectively, and engagement sections 102, 118 are folded over sections 108*a*, 112*a*, respectively, to complete the second form. To retain the actuatable container 100 in the second form, a voltage may be applied to the actuatable container 100, energizing the first electrode panel 100*a* and the second electrode panel 100*b*. It should be appreciated that the attraction between the electrode panels 100*a*, 100*b* may be strengthened without overlap between engagement sections 102, 106, 114, 118 with adjacent sections of the electrode panels 100*a*, 100*b*. To create overlap, engagement sections, such as the engagement sections 102, 106, 114, 118, may be included. For example, a first engagement section may be folded such that the first engagement section comes in contact with the second electrode panel 100*b*, and a second engagement section may be folded such that the second engagement section comes in contact with the first electrode panel 100*a*. It should be understood that sections may double as engagement sections and that the phrase "engagement section" indicates a role of a section.

Engagement sections 106, 114 have a positive polarity because they belong to the first electrode panel 100*a*, which has a positive polarity, and engagement sections 102, 118 have a negative polarity because they belong to the second electrode panel 100*b*, which has a negative polarity. Engagement sections 106, 114, which have a positive polarity, may be folded such that they stick to sections 108*b*, 112*b*, respectively, which have a negative polarity. Similarly, engagement sections 102, 118, which have a negative polarity, may be folded such that they stick to sections 108*a*, 112*a*, respectively, which have a positive polarity. When the voltage is applied, the actuatable container 100 may retain the second form due to the electromagnetic attraction between the electrode panels 100*a*, 100*b* and the overlapping engagement sections. In some embodiments, the engagement sections 102, 106, 114, 118 may create additional facets in the second form.

Figure 1F:
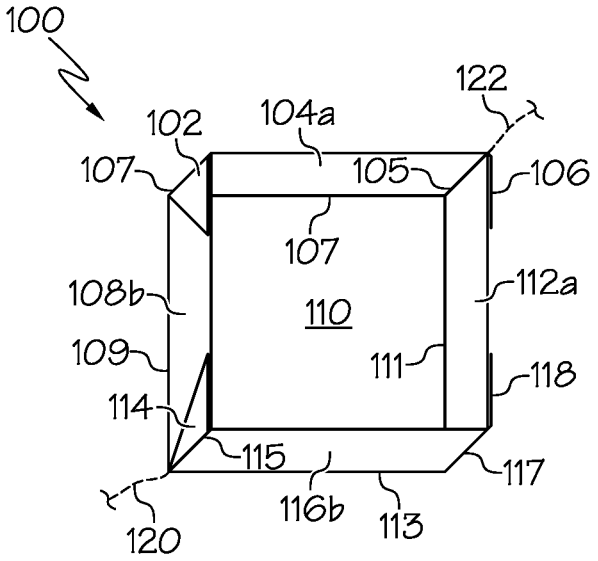
FIG. 1F depicts a perspective view of the actuatable container of FIG. 1C formed into a third position, according to one or more embodiments shown and described herein.

Referring to FIG. 1F, the actuatable container 100 may retain its second form because the first electrode panel 100*a* is electrically engageable with the second electrode panel 100*b*, upon application of a voltage to the first electrode panel 100*a* and/or the second electrode panel 100*b*. The actuatable container 100 may be disassembled when no longer in use by discontinuing the voltage and unfolding the actuatable container 100 in the reverse steps depicted in FIGS. 1C-1F. Although the second form is depicted as a cube having an opening above section 110, the second form may be any other polyhedron shape. Additionally, it is not required that the second form have an opening. Additionally, in embodiments, the actuatable container 100 may have more than two electrodes according to the shape of the second form desired.

Figure 2A:
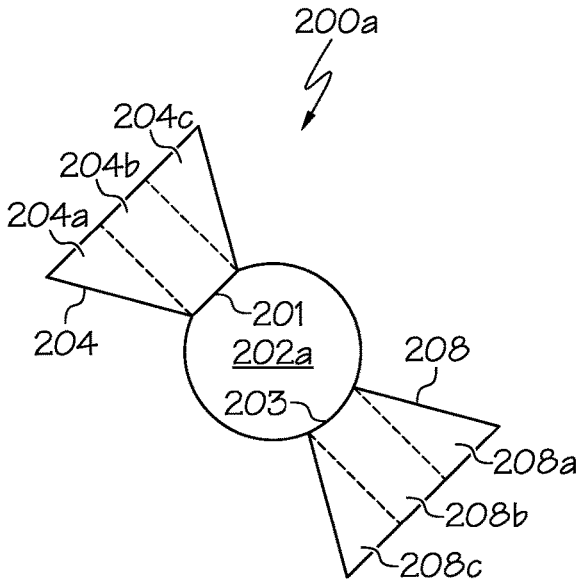
FIG. 2A depicts a plan view of a first electrode panel, according to one or more embodiments shown and described herein.

Referring now to FIG. 2A, an actuatable container 200 is depicted. The actuatable container 200 may include a plurality of electrode panels. A first electrode panel 200*a* of the plurality of electrode panels includes an electrode, an electrode insulation coating surrounding the electrode, an electrode lead, and a plurality of fold regions. The actuatable container 200 has a first form that is a flat planar shape and the second form that is a cylinder. A cylindrical actuatable container 200 may function as a cup holder, for example. The various components of the first electrode panel 200*a* will be discussed in more detail herein with reference to FIG. 4.

Similar to the first electrode panel 100*a* of the actuatable container 100 discussed herein, the first electrode panel

200*a* may also have a plurality of sections 204*a*, 204*b*, 204*c*, 208*a*, 208*b*, 208*c*. The plurality of sections 204*a*, 204*b*, 204*c*, 208*a*, 208*b*, 208*c* are separated from one another by a plurality of fold regions 201, 203. The fold regions 201, 203 may be any part of the first electrode panel 200*a* which permit the plurality of sections 204*a*, 204*b*, 204*c*, 208*a*, 208*b*, 208*c* to fold relative to one another. For example, a fold region 201, 203 may be a crease, bend, or the like. The fold regions 201, 203 of the first electrode panel 200*a* may be placed such that the first electrode panel 200*a* is foldable along any of the plurality of fold regions 201, 203. Being foldable allows the first electrode panel 200*a* or the sections 204*a*, 204*b*, 204*c*, 208*a*, 208*b*, 208*c* to move between the first form and the second form. In the first form, the first electrode panel 200*a* may be flat, and thus the fold regions 201, 203 may not be apparent. In the second form, which may be a cylindrical shape, the fold regions 201, 203 of the first electrode panel 200*a* may make up one or more edges and the sections 204*a*, 204*b*, 204*c*, 208*a*, 208*b*, 208*c* define one or more faces of the second form.

The first electrode panel 200*a* may start in the first form, such as a flat planar shape. When the first electrode panel 200*a* is folded, it may take the second form, such as a cylindrical shape. In some embodiments, the second form may include one or more openings for holding one or more objects, such as a cup. The first electrode panel 200*a* may also take a third or a plurality of additional forms either intermediate of the first form and the second form or subsequent to the second form. Folding may occur manually or automatically, such as by generating a voltage throughout the first electrode panel 200*a*. To fold the first electrode panel 200*a* manually, a user may fold the first electrode panel 200*a* at one or more fold regions 201, 203 from the first form to the second form and actuate the first electrode panel 200*a* to retain the second form. To fold automatically, the user may actuate the first electrode panel 200*a* by applying a voltage applied to the first electrode panel 200*a* and, in response to actuation may cause the first electrode panel 200*a* to fold at one or more fold regions 201, 203 from the first form to the second form and, in some embodiments, retain the second form.

Figure 2B:
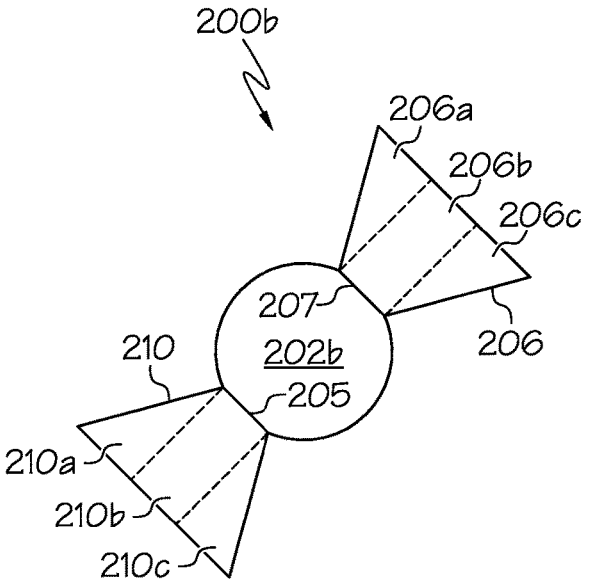
FIG. 2B depicts a plan view of a second electrode panel, according to one or more embodiments shown and described herein.

The first electrode panel 200*a* may be electrically engageable with one or more other electrode panels, such as a second electrode panel 200*b* illustrated in FIG. 2B. The electrode panels 200*a*, 200*b* may be electrically engaged with one another and retain the second form upon application of the voltage. Once electrically engaged, the electrode panels 200*a*, 200*b* may be attracted to each other and retain the second form. A voltage may also be applied when the first electrode panel 200*a* is in the first form to keep the first electrode panel 200*a* flat with the surface. In some embodiments, the sections 204, 208 first electrode panel 200*a* may have one or more engagement sections 204*a*, 204*c*, 208*a*, 208*c* that are electrically engageable with corresponding engagement sections 206*a*, 206*c*, 210*a*, 210*c* of the second electrode panel 200*b*. For example, the first electrode panel 200*a* may have a flap, a wing, a tongue, and/or the like that is folded over the second electrode panel 200*b* when in the second form to retain or strengthen retention of the second form when a voltage is applied. For added security, the second electrode panel 200*b* may also have a flap, a wing, a tongue, and/or the like that is folded over the first electrode panel 200*a* when in the second form to retain or strengthen retention of the second form when a voltage is applied.

The first electrode of the first electrode panel 200*a* may be connected to a power supply 506 (FIG. 5) that gives the first electrode panel 200*a* a positive polarity. The second electrode of the second electrode panel 200*b* may be connected to a power supply 506 (FIG. 5) that gives the second electrode panel 200*b* a negative polarity. The difference in polarity between the first electrode panel 200*a* and the second electrode panel 200*b* allows the electrode panels 200*a*, 200*b* to stick or electrically adhere together. For example, in FIG. 2A, the first electrode panel 200*a* may be placed atop the second electrode panel 200*b*. When a voltage is applied to the first electrode panel 200*a* and the second electrode panel 200*b*, the first electrode panel 200*a* may stick to the second electrode panel 200*b* due to the difference in their polarity. The applied voltage may also help the first electrode panel 200*a* and the second electrode panel 200*b* stay flat on a surface when not in use.

The first electrode panel 200*a* and the second electrode panel 200*b* may be placed on top of one another and folded to move from a first form to a second form, thereby creating a container having a cylinder shape with an open top. After folding, a voltage may be applied or maintained to the first electrode panel 200*a* and/or the second electrode panel 200*b* to retain the first electrode panel 200*a* and the second electrode panel 200*b* in the second form. In some embodiments, applying a voltage may automatically fold the electrode panels 200*a*, 200*b* from the first form to the second form and keep the electrode panels 200*a*, 200*b* in the second form.

Referring now to FIG. 2B, the second electrode panel 200*b* is illustrated. It should be appreciated that the second electrode panel 200*b* complements the first electrode panel 200*a* described above. As such, the second electrode panel 200*b* may be identical in structure or a mirror image to the first electrode panel 200*a*. Accordingly, the second electrode panel 200*b* may include an electrode, an electrode insulation coating surrounding the electrode, and an electrode lead. Each component of the second electrode panel 200*b* is similar to the corresponding component of the first electrode panel 200*a*. Accordingly, the second electrode panel 200*b* may have sections 206, 210 separated by fold regions 205, 207.

Figure 2C:
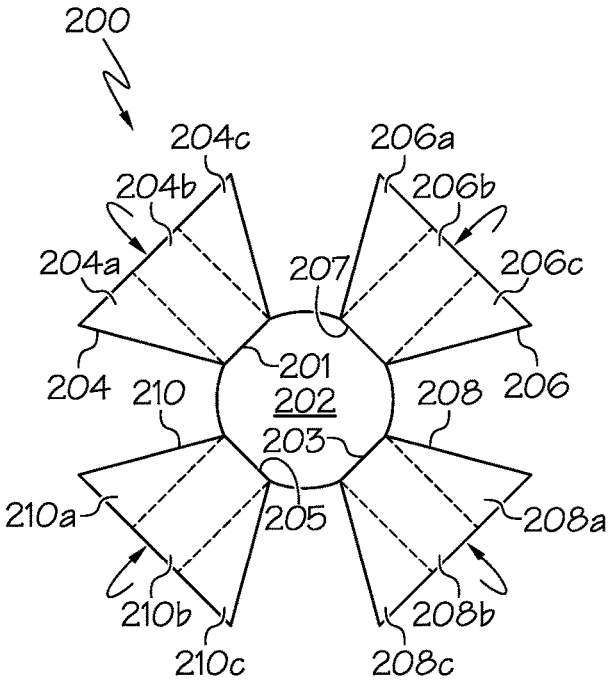
FIG. 2C depicts a plan view of the first electrode panel of FIG. 2A and the second electrode panel of FIG. 2B forming an actuatable container, according to one or more embodiments shown and described herein.

Referring now to FIG. 2C, an actuatable container 200 formed by placing the first electrode panel 200*a* and the second electrode panel 200*b* on top of one another is depicted. The actuatable container 200, when not in use, may lay in a first position, which may be any planar shape. A plurality of sections 204, 206, 208, 210 of the electrode panels 200*a*, 200*b* are defined at least in part by fold regions 201, 203, 205, 207. The fold regions 201, 203, 205, 207 make the actuatable container 200 foldable along the fold regions 201, 203, 205, 207. Accordingly, the actuatable container 200 may be folded along the fold regions 201, 203, 205, 207 at the sections 204, 206, 208, 210 to enclose the space around the section 202 and form an opening above the section 202 with sections 204, 206, 208, 210. The sections 204, 206, 208, 210 may be folded such that they are perpendicular to the base section 202, which is formed by sections 202*a*, 202*b* of the first electrode panel 200*a* and the second electrode panel 200*b*, respectively.

Each section of the plurality of sections 204, 206, 208, 210 may be divided into sub-sections. For example, section 204 has sub-sections 204*a*, 204*b*, 204*c*, section 206 has sub-sections 206*a*, 206*b*, 206*c*, section 208 has sub-sections 206*a*, 206*b*, 206*c*, section 208 has sub-sections 208*a*, 208*b*, 208*c*, and section 210 has sub-sections 210*a*, 210*b*, 210*c*. One or more sub-sections of the plurality of sections 204, 206, 208, 210 may be considered engagement sections. For example, section 204 has engagement sections 204*a*, 204*c*, section 206 has engagement sections 206*a*, 206*c*, section 208 has engagement section 208*a*, 208*c*, and section 210 has engagement section 210*a*, 210*c*. The engagement sections 204*a*, 204*c*, 206*a*, 206*c*, 208*a*, 208*c*, 210*a*, 210*c* are sections that may overlap with each other to engage or improve engagement between the first electrode panel 200*a* with the second electrode panel 200*b* and vice versa.

Figure 2D:
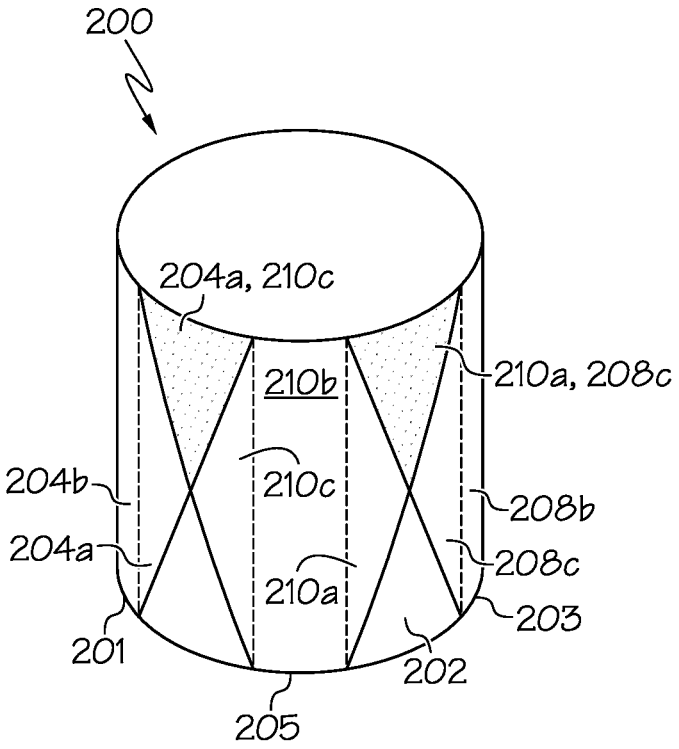
FIG. 2D depicts a perspective view of the actuatable container of FIG. 2C formed into a first position, according to one or more embodiments shown and described herein.

Referring now to FIG. 2D, the sections 204, 206, 208, 210 are folded up and overlap with each other to complete the second form. For example, the sections 204*c*, 206*a*, sections 208*a*, 206*c*, sections 210*a*, 208*c*, and sections 204*a*, 210*c* overlap. To retain the actuatable container 200 in the second form, a voltage may be applied to the actuatable container 200, energizing the first electrode panel 200*a* and the second electrode panel 200*b*. The sections 204, 208 have a positive polarity because they belong to the first electrode panel 200*a*, which has a positive polarity, and sections 206, 210 have a negative polarity because they belong to the second electrode panel 200*b*, which has a negative polarity. Sections 204, 208, which have a positive polarity, may be folded such that they overlap and stick to sections 206, 210, which have a negative polarity.

Although the space above section 202 is now at least partially enclosed by the sections 204, 206, 208, 210, the actuatable container 200 may not retain the second form until a voltage is applied. When the voltage is applied, the actuatable container 200 may retain the second form due to the electromagnetic attraction between the electrode panels 200*a*, 200*b*. Unlike the actuatable container 100 described above, the sections 204, 206, 208, 210 of the actuatable container 200 may have built-in engagement sections. A first engagement section may be folded such that the first engagement section comes in contact with the second electrode panel 200*b*, and a second engagement section may be folded such that the second engagement section comes in contact with the first electrode panel. For example, the sections 204*c*, 206*a*, sections 208*a*, 206*c*, sections 210*a*, 208*c*, and sections 204*a*, 210*c* overlap and may be attracted to each other when a voltage is applied, in which case sections 204*b*, 206*b*, 208*b*, 210*b* can be made of the same or different material.

The actuatable container 200 may retain its second form because the first electrode panel 200*a* is electrically engageable with the second electrode panel 200*b*, upon application of a voltage to the first electrode panel 200*a* and/or the second electrode panel 200*b*. The actuatable container 200 may be disassembled when no longer in use by removing the voltage and performing the steps shown in FIGS. 2A-2C in reverse order. It should be understood that it is not required that the second form have any openings.

Figure 3A:
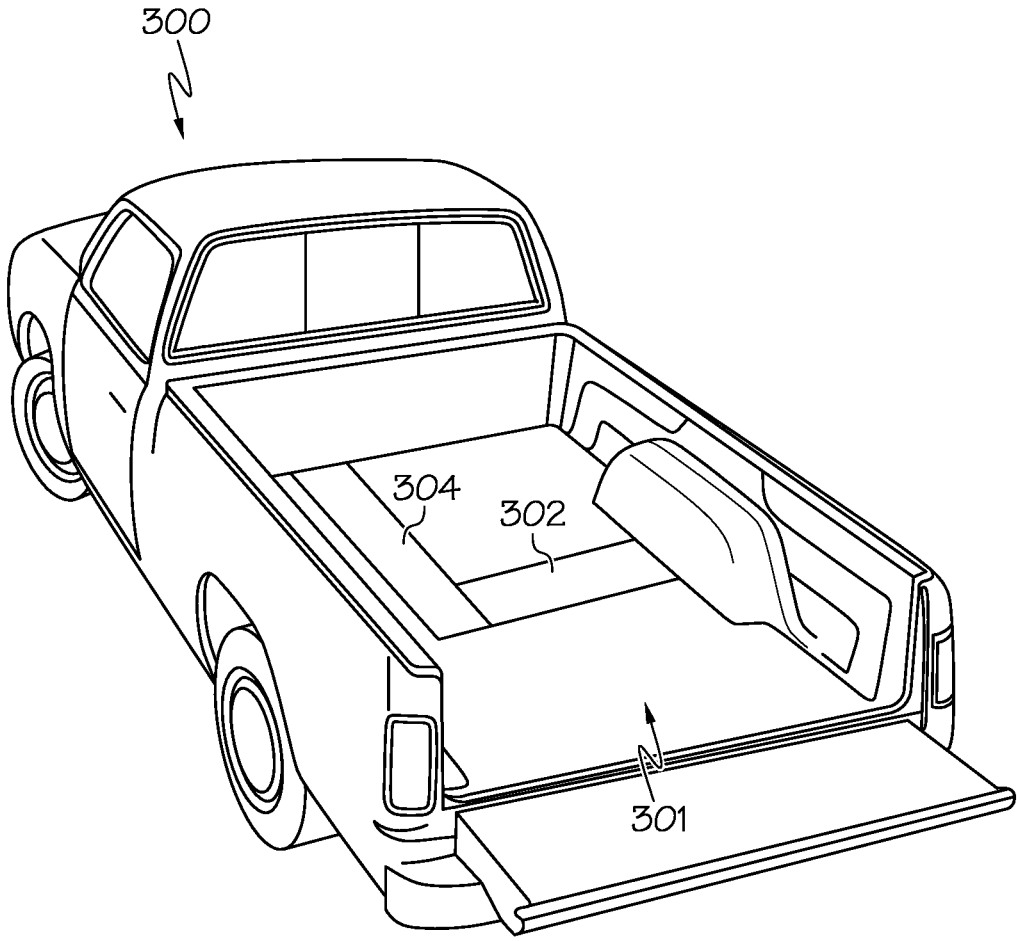
FIG. 3A depicts a perspective view of a truck bed having an actuatable container in a first form, according to one or more embodiments shown and described herein.

Referring now to FIG. 3A, a truck 300 having an actuatable container is depicted. The actuatable container includes a first container segment 302 and a second container segment 304. Each of the container segments 302, 304 may have a structure similar to the actuatable container 100 discussed herein. As such, each container segment 302, 304 includes electrode panels that may form the walls of the container segments 302, 304. One electrode panel of each of the container segments 302, 304 has a positive polarity and the other electrode panel of the container segments 302, 304 has a negative polarity. As shown, the container segments 302, 304 are arranged to intersect one another and divide the surface 301 of the truck 300 to create a container. The container segments 302, 304 may be integrally formed with one another or separable. However, it should be appreciated that other arrangements of the actuatable container are contemplated.

The materials used to create the electrode panels of the container segments 302, 304 result in the electrode panels being thin enough to substantially blend in with a surface 301 of the truck 300 upon which they rest. For example, the electrode panels may only be less than 5 millimeters and thus may be substantially flush with the surface 301 upon which they rest. As another example, the surface 301 may include an indentation having a depth equivalent to the thickness of the electrode panels such that the electrode panels are flush with the surface 301 upon which they rest. Due to the thinness of the materials making up the electrodes, the electrode panels of each electrode may lay nearly flat on the surface 301 of the truck 300. Because the electrode panels lay flat, objects may slide into and out of the surface 301 of the truck 300 without obstruction by sections, whereas conventional mechanical modular containers may be several inches thick when not in use and inhibit the placement of objects in the surface 301 of the truck 300.

Figure 3B:
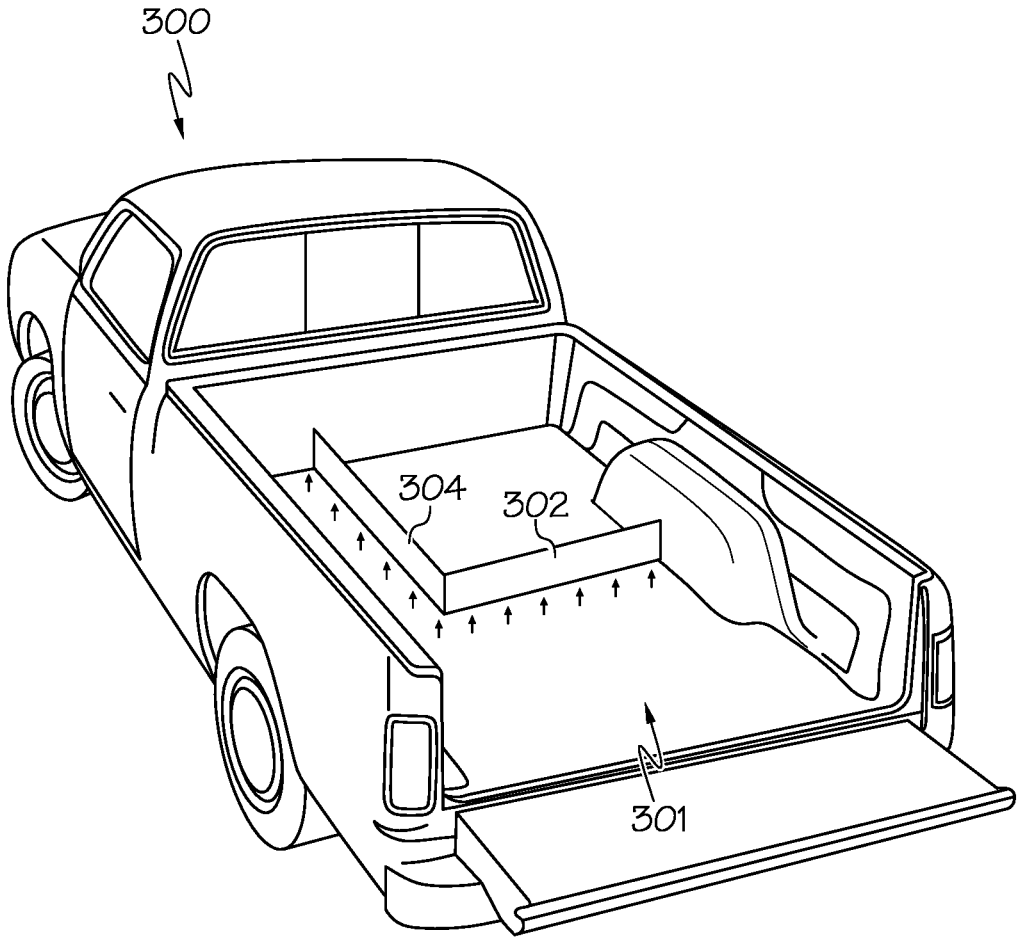
FIG. 3B depicts a perspective view of the truck bed of FIG. 3A with the actuatable container in a second form, according to one or more embodiments shown and described herein.

As shown in FIG. 3B, some or all of the container segment 302 may be electrically engageable with some or all of the container segment 304. When a voltage is applied, the container segments 302, 304 may retain their second form to keep objects on the surface 301 of the truck 300 in place. When the voltage is removed, the container segments 302, 304 may return to their first form, as shown in FIG. 3A.

Figure 4:
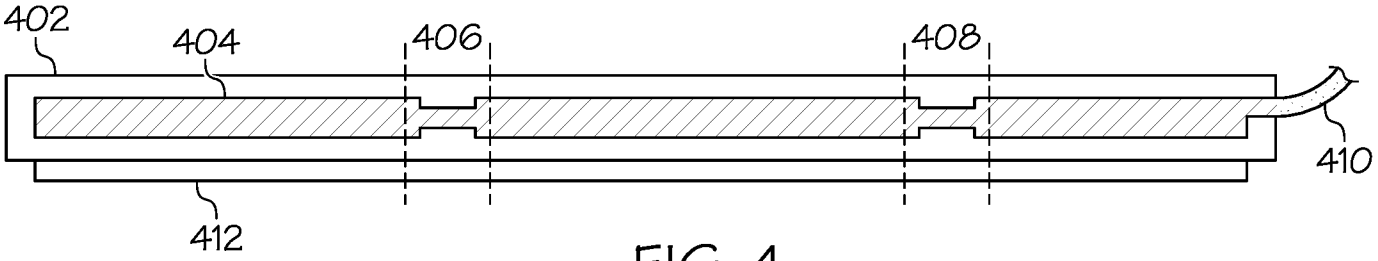
FIG. 4 depicts a cross-sectional view of an electrode panel, according to one or more embodiments shown and described herein.

Referring now to FIG. 4, a cross-sectional view of an electrode panel 400, such as the first electrode panel 100*a* and the second electrode panel 100*b*, is depicted. The electrode panel 400 may include an electrode 404, and an electrode insulation coating 402. The electrode 404 may have one or more fold regions 406, 408 located anywhere along the electrode 404 to divide the electrode 404 into sections, as discussed herein.

The electrode 404 of the electrode panel 400 may be any conductor, such as any metalized polyester film (e.g., Mylar). In some embodiments, the metalized polyester film may be aluminum-based, gold-based, or any other conductive metal. An electrode lead 410 may be connected to the electrode 404 for passing a voltage to the electrode 404. Depending on the voltage passing through the electrode 404, the electrode 404 may have a positive or negative polarity.

As noted above, the electrode 404 may be surrounded with an electrode insulation coating 402 to protect the electrode 404. For example, when the electrode panel 400 is laid flat (e.g., in a first form), the electrode insulation coating 402 protects the electrode 404 as objects may be placed over the electrode panel 400. The electrode insulation coating 402 may be any electrical insulator material such as a polymer, plastic, and/or the like. The electrode insulation coating 402 may also include additional coatings or textures to provide. For example, the electrode insulation coating 402 may be textured such that when the actuatable container is in a second form, an interior of the actuatable container has added grip for retaining an object inserted into the actuatable container. The electrode insulation coating 402 of the electrode panel 400 may surround its electrode 404. In embodiments having an electrode lead 410, the electrode insulation coating 402 may also surround at least part of the electrode lead 410.

In some embodiments, the electrode panel 400 may contain one or more structural support layers (e.g., the structural support layer 412) attached to the electrode panel 400 to provide added rigidity for strengthening the electrode panel 400. In some embodiments, the structural support layer 412 may also be electrically engageable in addition to or instead of the electrode 404. For example, the structural support layer 412 may become rigid upon application of a voltage. In other embodiments, the electrode panel 400 may fold itself from the first form to the second form due to the structural support layer 412 becoming rigid upon the application of the voltage.

Figure 5:
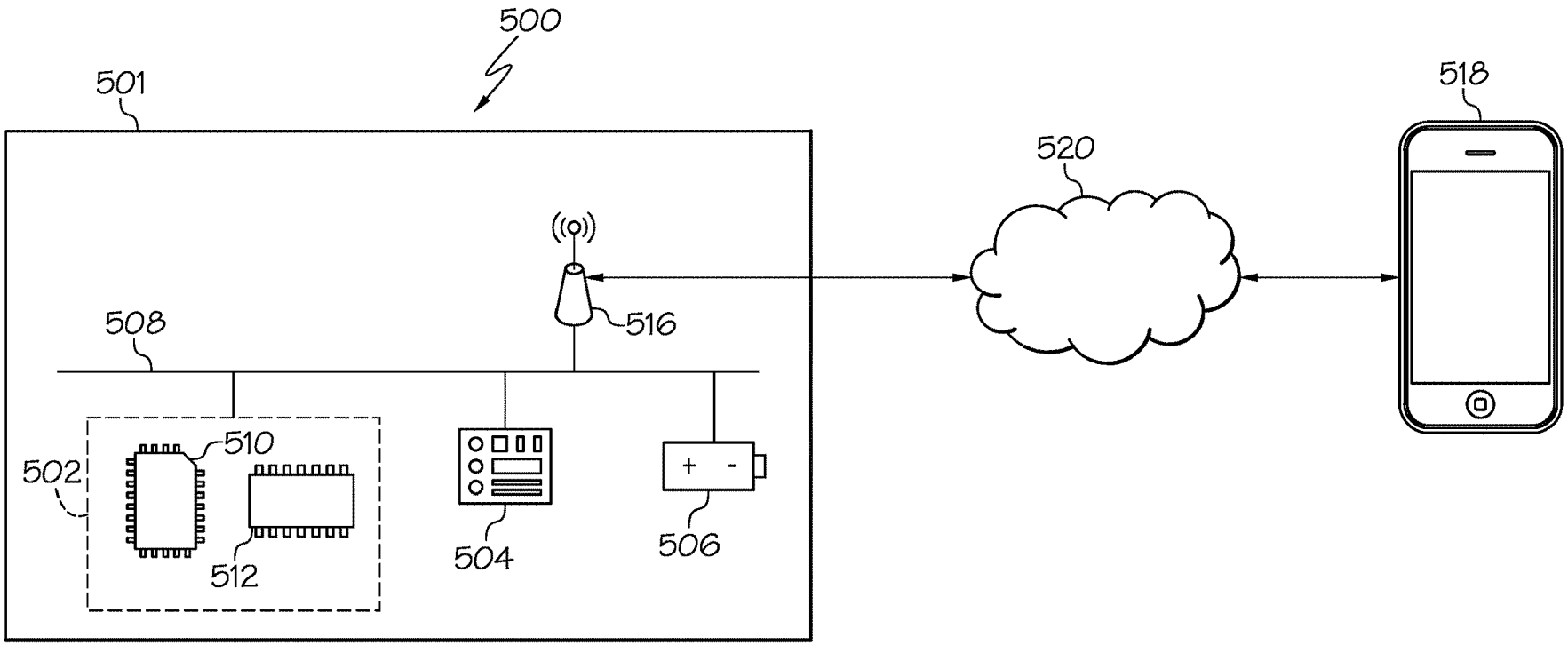
FIG. 5 depicts a system for operating the actuatable container, according to one or more embodiments shown and described herein.

Referring now to FIG. 5, a system 500 for operating an actuatable container 501, such as actuatable containers 100, 200, 300, is depicted. The system 500 may include a controller 502, an operating device 504, and a power supply 506. The system 500 may also include a communication path 508 for communicatively coupling the various components of the system 500.

The controller 502 includes a processor 510 and a non-transitory electronic memory 512 to which various components are communicatively coupled. In some embodiments, the processor 510 and the non-transitory electronic memory 512 and/or the other components are included within a single device. In other embodiments, the processor 510 and the non-transitory electronic memory 512 and/or the other components may be distributed among multiple devices that are communicatively coupled. The controller 502 includes non-transitory electronic memory 512 that stores a set of machine-readable instructions. The processor 510 executes the machine-readable instructions stored in the non-transitory electronic memory 512. The non-transitory electronic memory 512 may comprise RAM, ROM, flash memories, hard drives, or any device capable of storing machine-readable instructions such that the machine-readable instructions can be accessed by the processor 510. Accordingly, the system 500 described herein may be implemented in any conventional computer programming language, as pre-programmed hardware elements, or as a combination of hardware and software components. The non-transitory electronic memory 512 may be implemented as one memory module or a plurality of memory modules. In some embodiments, the non-transitory electronic memory 512 includes instructions for executing the functions of the system 500.

The processor 510 may be any device capable of executing machine-readable instructions. For example, the processor 510 may be an integrated circuit, a microchip, a computer, or any other computing device. The non-transitory electronic memory 512 and the processor 510 are coupled to the communication path 508 that provides signal interconnectivity between various components and/or modules of the system 500. Accordingly, the communication path 508 may communicatively couple any number of processors with one another, and allow the modules coupled to the communication path 508 to operate in a distributed computing environment. Specifically, each of the modules may operate as a node that may send and/or receive data. As used herein, the term "communicatively coupled" means that coupled components are capable of exchanging data signals with one another such as, for example, electrical signals via conductive medium, electromagnetic signals via air, optical signals via optical waveguides, and the like.

The communication path 508 communicatively couples the processor 510 and the non-transitory electronic memory 512 of the controller 502 with a plurality of other components of the system 500. For example, the system 500 includes the processor 510 and the non-transitory electronic memory 512 communicatively coupled with the operating device 504 and the power supply 506.

The operating device 504 allows for a user to control the operation of the actuatable container 501. In some embodiments, the operating device 504 may be a switch, toggle, button, or any combination of controls to provide user operation. As a non-limiting example, a user may actuate the actuatable container 501 into a first form by activating controls of the operating device 504 to a first position. The user may switch the actuatable container 501 into the second form by operating the controls of the operating device 504 out of the first position and into a second position.

The power supply 506 (e.g., battery) provides power to the actuatable container 501. In some embodiments, the power supply 506 is a rechargeable direct current power source. It is to be understood that the power supply 506 may be a single power supply or battery for providing power to the actuatable container 501. A power adapter (not shown) may be provided and electrically coupled via a wiring harness or the like for providing power to the actuatable container 501 via the power supply 506.

In some embodiments, the system 500 includes a network interface hardware 516 for communicatively coupling the system 500 to a portable device 518 via a network 520. The portable device 518 may include, without limitation, a smartphone, a tablet, a personal media player, or any other electric device that includes wireless communication functionality. It is to be appreciated that, when provided, the portable device 518 may serve to provide user commands to the controller 502, instead of the operating device 504. Thus, the actuatable container 501 may be controlled remotely via the portable device 518 wirelessly communicating with the controller 502 via the network 520.

It should now be understood that embodiments of the actuatable container described herein include a plurality of electrode panels that lay flat and flush with a surface when not in use. The electrode panels may be folded to form a container when ready for use and retain the form by receiving a voltage through the electrode panels.

For the purposes of describing and defining embodiments of the present disclosure, it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

What is claimed is:

1. An actuatable container, comprising:

a first electrode panel and a second electrode panel, wherein:

the first electrode panel and the second electrode panel each comprises an electrode, an electrode insulation coating surrounding the electrode, an electrode lead, and a plurality of fold regions;

the first electrode panel and the second electrode panel are each foldable along the plurality of fold regions to permit the first electrode panel and the second electrode panel to move between a first form and a second form; and the first electrode panel is electrically engageable with the second electrode panel, upon application of a voltage to at least one of the first electrode panel or the second electrode panel, to retain the first electrode panel and the second electrode panel in the second form.

2. The actuatable container of claim 1, wherein the first form is a planar shape.

3. The actuatable container of claim 1, wherein the second form is a polyhedron shape.

4. The actuatable container of claim 1, wherein, in the second form, an opening is defined by the first electrode panel and the second electrode panel.

5. The actuatable container of claim 1, wherein the electrode of the first electrode panel is positively charged and the electrode of the second electrode panel is negatively charged.

6. The actuatable container of claim 1, wherein the electrode of the first electrode panel and the electrode of the second electrode panel comprises an metalized polyester film.

7. The actuatable container of claim 1, wherein the electrode insulation coating of the first electrode panel and the electrode insulation coating of the second electrode panel surrounds the respective electrodes of the first electrode panel and the second electrode panel.

8. The actuatable container of claim 1, wherein the electrode insulation coating of the first electrode panel and the electrode insulation coating of the second electrode panel each comprises a polymer.

9. The actuatable container of claim 1, further comprising a structural support layer attached to a surface of the first electrode panel opposite the second electrode panel.

10. The actuatable container of claim 9, wherein a rigidity of the structural support layer increases upon application of the voltage.

11. The actuatable container of claim 1, wherein the first electrode panel comprises a first engagement section that is electrically engageable with the second electrode panel.

12. The actuatable container of claim 11, wherein the second electrode panel comprises a second engagement section that is electrically engageable with the first electrode panel.

13. An actuatable container comprising:

a first electrode panel comprising:

one or more fold regions; and a plurality of sections defined by the one or more fold regions;

a second electrode panel overlapping the first electrode panel, the second electrode panel comprising:

one or more fold regions; and a plurality of sections defined by the one or more fold regions; and a power supply for delivering a voltage to at least one of the first electrode panel or the second electrode panel, wherein the actuatable container is positionable between a first form in which the plurality of sections of the first electrode panel and the plurality of sections of the second electrode panel are parallel to one another, and a second form in which one or more sections of the plurality of sections of the first electrode panel and one or more sections of the second electrode panel fold at corresponding fold regions such that the one or more sections of the first electrode panel and the one or more sections of the second electrode panel are perpendicular to other sections of the first electrode panel and other sections of the second electrode panel.

14. The actuatable container of claim 13, wherein the second electrode panel is overlaid atop and electrically engageable with the first electrode panel.

15. The actuatable container of claim 14, wherein the second electrode panel is a mirror image of the first electrode panel.

* * * * *